United States Patent [19]

Rosenthal

[11] Patent Number: 4,874,343

[45] Date of Patent: Oct. 17, 1989

[54] TOY DETECTION AND SIGNALING CIRCUIT

[75] Inventor: Doren Rosenthal, Sal Luis Obispo, Calif.

[73] Assignee: Mattel, Inc., Hawthorne, Calif.

[21] Appl. No.: 113,104

[22] Filed: Oct. 23, 1987

[51] Int. Cl.[4] ..... A63H 30/00; A63H 33/22; A63H 3/28

[52] U.S. Cl. ..... 446/175; 446/219; 446/297

[58] Field of Search ..... 446/175, 219, 191, 473, 446/484, 485, 297

[56] References Cited

U.S. PATENT DOCUMENTS

| | | | |
|---|---|---|---|
| 3,064,390 | 11/1962 | Barnes | 446/175 |
| 3,130,803 | 4/1964 | Wiggins | 446/175 |
| 3,274,729 | 9/1966 | Refabert | 446/191 |
| 4,147,996 | 4/1979 | Gontowski, Jr. | 331/111 |
| 4,199,753 | 4/1980 | Gontowski, Jr. | 340/555 |
| 4,201,012 | 5/1980 | Marshall | 446/175 |
| 4,479,329 | 10/1984 | Fraden | 446/175 |
| 4,659,919 | 4/1987 | Price | 446/297 |
| 4,662,854 | 5/1987 | Fang | 446/175 |
| 4,675,519 | 6/1987 | Price | 446/297 X |

*Primary Examiner*—Robert A. Hafer
*Assistant Examiner*—D. Neal Muir
*Attorney, Agent, or Firm*—Roy A. Ekstrand

[57] ABSTRACT

A toy figure for detecting and signaling changes in ambient light level in which a detection circuit includes an operational amplifier acting as a comparator for comparing two signals from a voltage divider network. The first input signal is the signal of interest to be detected. The second input signal is held stable by a capacitor with a relatively long time constant. When the first signal exceeds the second signal, a change in output of the comparator is produced to effect both radiation and audio signal outputs from the toy figure.

9 Claims, 2 Drawing Sheets

TOY DETECTION AND SIGNALING CIRCUIT

BACKGROUND OF THE INVENTION

1. Field of the Invention

The invention generally relates to the field of toys for detecting and signaling changes in ambient light level during a play mode of operation.

2. Description of the Prior Art

It is well known to have toys that are responsive to differences in light levels as indicated by the prior art listed below.

U.S. Pat. No. 3,064,390 shows an electrical toy gun controlled in part by a switch and in part by a light sensitive device.

U.S. Pat. No. 3,130,803 shows a toy tracking vehicle adapted to follow a path defined by light and dark areas.

U.S. Pat. No. 3,274,729 shows a doll having photocell actuated sounding means.

U.S. Pat. No. 4,147,996 shows a current controlled oscillator.

U.S. Pat. No. 4,199,753 shows an integrated circuit for detecting changes in light intensity.

U.S. Pat. No. 4,479,329 shows a toy including motion detecting means for activating the toy.

U.S. Pat. No. 4,659,919 shows a noise generating toy including optical sensors to detect the intensity of light in first and second optical fields, respectively.

U.S. Pat. No. 4,662,854 shows a self-propellable toy and arrangement for controlling the toy by an on-board infrared light transmitter and receiver.

SUMMARY OF THE INVENTION

1. Objects of the Invention

Accordingly, it is a general object of this invention to improve the prior art toy detection and signaling devices.

It is another object of this invention to provide an improved detection circuit for a toy which is sensitive to changes in light to produce desirable gain to wanted light changes while ignoring unwanted changes.

It is a further object of the invention to provide a toy which has a detection circuit that is self-adjusting to maintain maximum sensitivity automatically.

2. Features of the Invention

In keeping with these objects and others which will become apparent hereinafter, the invention briefly stated is a detection circuit which includes an operational amplifier functioning as a comparator for comparing two input signals supplied from a voltage divider network. The first input signal is the signal of interest to be detected. The second input signal is held stable by a capacitor with a relatively long time constant. When the first signal exceeds the second signal, a change in output of the comparator is produced to produce both radiation and audio signal outputs from the toy figure.

DETAILED DESCRIPTION OF THE PREFERRED EMBODIMENT

Figure 1:
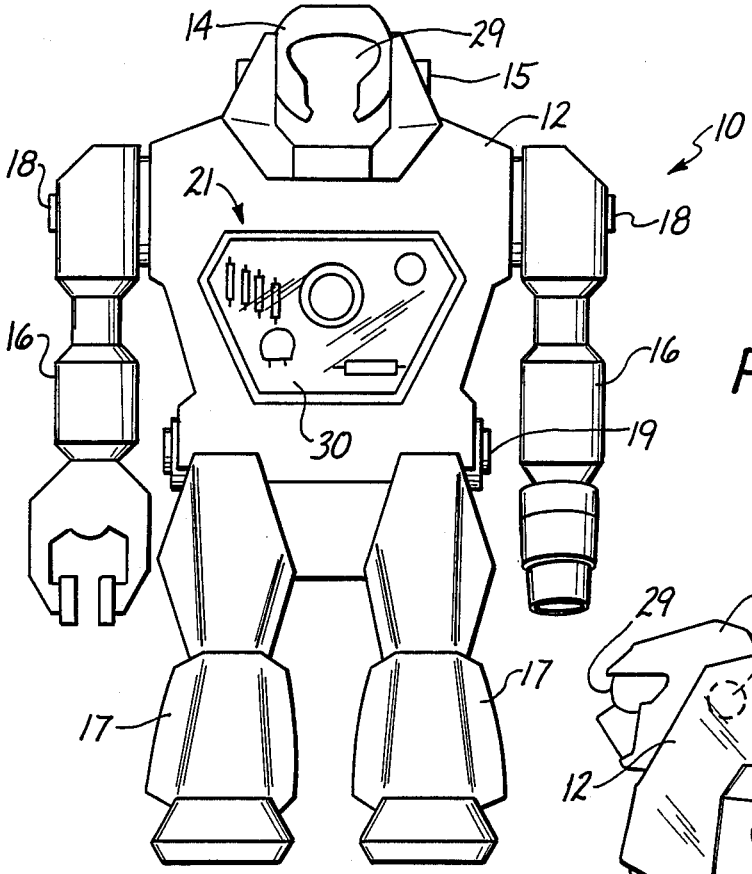
FIG. 1 shows a front elevation view of a toy figure assembly incorporating an improved detection and signaling circuit according to the present invention.
Figure 2:
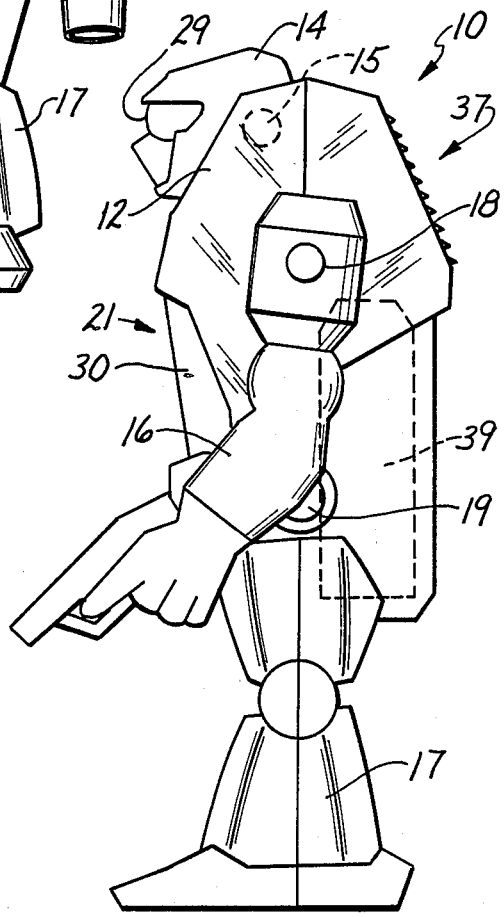
FIG. 2 shows a side elevation view thereof.

FIGS. 1 and 2 show a toy figure assembly 10 including a torso 12, head 14, arms 16, and legs 17. The head 14 is tiltable on an axis 15, and the arms are pivotable on an axis 18, and the legs are pivotable on an axis 19 to enhance play action.

A cavity is formed in the chest 21 of torso 12 to receive a detection and signaling circuit (FIG. 3) positioned on a circuit board. The purpose of the circuit is to detect and signal changes in ambient light during a play mode of operation. The circuit includes a phototransistor or photosensitive receptor Q1 (FIG. 3) positioned in head 14. Head 14 includes a lens 29 for focusing ambient illumination onto the phototransistor Q1.

Chest 21 is covered with a transparent window 30 for the purpose of emitting radiation signals in response to changes in ambient light. Preferably an output signal is a visual light LED 35 (FIG. 3) flashing at a predetermined frequency, for example, 15 Hz, during a game mode of operation for signaling intruders. A second LED 36 emits a signaling beam of infrared radiation flushed or varied at any suitable frequency as, for example, 15 Hz, for activating infrared response toys during a particular playing mode. Positioned on the back of the assembly 10 is a piezo speaker 37 for producing audio signals signaling changes in ambient light levels. One or more batteries 39 serve as a voltage supply for the circuit which is energized by closing a switch 40.

Figure 3:
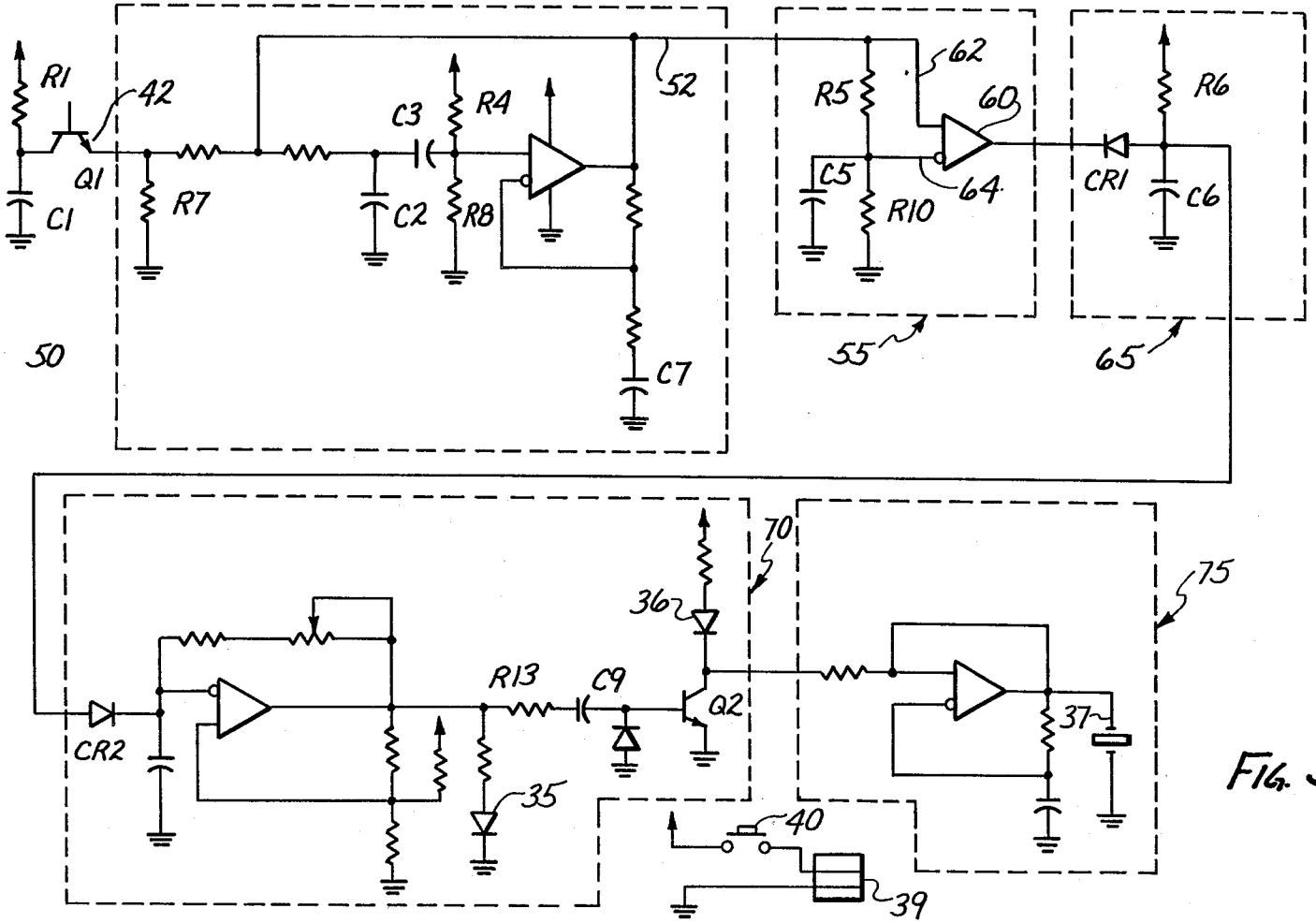
FIG. 3 is a electrical schematic diagram of the detection and signaling circuit according to the invention.

Referring to FIG. 3, there is shown the detection and signaling circuit of the invention. A change in light intensity is detected by the phototransistor Q1 developing a signal 42 which is decoupled from power supply interference by the combination of R1 and C1. Desirably the phototransistor is sensitive to both visible and infrared light for the playing mode of operation for the toy.

The signal 42 is then supplied to a band pass amplifier 50 which limits the frequency response so as not to be effected by the flicker of AC operated room lights. The amplifier 50 is biased to one half the supply voltage by resistors R4 and R8 with power supply noise decoupled with capacitors C2 and C3. Operation of this stage at about the one half power supply level is maintained by using capacitors C3 and C7 to block the DC level from the voltage divider formed by R1, R7 and Q1. This insures operation over a wide range of lighting conditions.

The output 52 of the band pass amplifier centers about the one half power supply point and is fed into the detector circuit 55. In accordance with the invention, detector circuit 55 automatically adjusts itself to compensate for varying input bias levels caused by drifting in components while maintaining a high degree of sensitivity. The detector circuit 55 is unique in that it uses an operational amplifier 60 as a comparator and maintains its stability automatically.

A non-inverting input 62 and inverting input 64 are brought very close to the same electrical potential by a resistor voltage divider network made up of resistors R5 and R10. Since the inputs 62 and 64 are comparing two points on the same resistor network, the inputs will always be separated by some offset bias voltage, insuring stability without the need of an adjustment. Input 62 to the operational amplifier has the signal 52 to be detected applied to it. Input 64 is held stable by a capacitor C5 with a relatively long time constant when compared to the detected signal 52. When the signal 62 exceeds the offset bias voltage at the comparator input 64, the output of comparator 60 will change. More specifically, in the quiescent state comparator 60 produces a high output. If the change in amplitude of signal 62 exceeds the offset bias voltage applied to signal 64, the output will change to a low output. This configuration allows for the detection of very small changes in input with a minimum of parts without the critical adjustment and instability problems normally associated with circuits of similar function.

The output of detector 55 is supplied to a timing circuit 65. Timing circuit 65 is made up of diode CR1, resistor R6 and capacitor 6. The output of the comparator 60 discharges capacitor C6 quickly through diode CR1 when a change in light is sensed. The capacitor C6 then charges slowly through resistor R6.

The output of timing circuit 65 is supplied to a Schmidtt oscillator 70. Schmidtt oscillator 70 runs at 15 Hz and is fairly stable over changes in power supply voltage changes. The oscillator 70 runs as long as capacitor C6 is discharged, but as soon as the voltage on diode CR2 is high enough, diode CR2 conducts and stalls the oscillator.

The duty cycle of the Schmidtt oscillator output is very close to 50% and drives an LED 35 directly to produce visible flashing light. A second LED 36 which desirably is infrared radiation is driven by a transistor Q2. Infrared radiation is desired for certain play modes of operation. The duty cycle is reduced in order to drive LED 36 at its maximum peak output without exceeding the parts average power dissipation rating by RC circuit resistor R13 and capacitor C9. LED 36 preferably is an infrared signal emitted at 15 Hz for a predetermined time, for example, three seconds.

The output of the transistor Q2 modulates an abbreviated Schmidtt oscillator audio generator 75 to drive the piezo speaker 37 to produce audio signals. Alternatively, a dynamic speaker could be used in place of the piezo speaker.

By the above circuit an improved toy detection and signaling device is produced for detecting and signaling changes in ambient light conditions during a play mode of operation. The improved circuit enables detection of very small changes in input with a minimum of parts without the critical adjustment and instability problems normally associated with circuits used heretofore.

While the invention has been particularly shown and described with reference to a preferred embodiment, it will be understood by those skilled in the art that the foregoing and other changes in form and details may be made therein without departing from the spirit and scope of the invention.

What is claimed is:

1. A toy for detecting and signaling changes in ambient light level comprising:

a toy figure assembly;

detection circuit means including a single photodetector responsive to ambient light and light reflected from moving objects to produce an electrical signal having lower frequency and higher frequency signal components and a comparator means having a frequency selective voltage divider network for causing said higher frequency signal component to be detected and said lower frequency signal component to be ignored whereby when said higher frequency signal component is of sufficient amplitude to exceed a predetermined bias voltage of said lower frequency signal component a change in output of said comparator means is produced; and signaling means disposed in said toy figure assembly responsive to said comparator means for producing signals in response to changes in the output of said comparator means.

2. A toy according to claim 1 wherein said signaling means includes an LED to emit infrared radiation which is flashed on and off at a frequency of about 15 Hz.

3. A toy according to claim 1 wherein said toy figure assembly includes a body portion having a transparent cover and said signaling means includes an LED positioned in overlying relationship with said transparent cover.

4. A toy according to claim 1 wherein the output of the detecting circuit means is supplied to a Schmidtt oscillator coupled to at least one LED.

5. A toy according to claim 4 wherein the output of the detecting circuit means is coupled to audio generator means for generating audio signals for a predetermined duration.

6. A toy according to claim 1 wherein signals supplied to said detection circuit means are received from a band pass amplifier means.

7. A toy according to claim 6 wherein said band pass amplifier receives input signals from a phototransistor.

8. A toy according to claim 7 wherein the toy figure assembly includes a head and said phototransistor is positioned in the head in overlying relationship with a lens positioned to receive ambient light.

9. A toy for detecting and signaling changes in ambient light level comprising:

a toy figure assembly having head, body, and limbs;

signaling means disposed in the body for producing radiation and audio signals;

a single phototransistor disposed in said head for producing a light responsive signal;

band pass amplifier means coupled to said phototransistor for receiving said light responsive signal from said phototransistor and supplying a pair of signal components; and detection circuit means including comparator means for comparing said pair of signal components and having a frequency selective voltage divider network, one of said signal components being the signal component of interest to be detected and the other of said signal components being held stable by a capacitor with a relatively long time constant whereby a change in output of said comparator means is produced thereby triggering signals from the signaling means when the one of said signal component pair of interest substantially exceeds the other of said signal components.

* * * * *